United States Patent [19]

Gutberlet

[11] 4,158,829

[45] Jun. 19, 1979

[54] ELECTROMAGNETICALLY OPERATED DC POWER CONTACTOR

[75] Inventor: Robert C. Gutberlet, Milwaukee, Wis.

[73] Assignee: Cutler-Hammer, Inc., Milwaukee, Wis.

[21] Appl. No.: 829,809

[22] Filed: Sep. 1, 1977

[51] Int. Cl.[2] ..... H01H 9/30

[52] U.S. Cl. ..... 335/201; 200/144 R

[58] Field of Search ..... 335/16, 195, 201, 202; 200/144 R

[56] References Cited

U.S. PATENT DOCUMENTS

| | | | |
|---|---|---|---|
| 2,635,158 | 4/1953 | Peter | 200/144 R |
| 3,092,699 | 6/1963 | Latour | 335/195 |
| 3,511,950 | 5/1970 | Boyd | 200/144 R |
| 3,612,796 | 10/1971 | Doos | 200/144 R |

*Primary Examiner*—George Harris

[57] ABSTRACT

An electromagnetically operated DC power contactor for high voltage and current use constructed to afford the required contact pressure at the arcing and main contacts with minimal magnet force together with the provision of contact wipe and shearing and rolling action to effect breaking of welds that might occur during contact closure due to bounce at the arcing contacts. A trifurcated movable contact structure is incorporated in this contactor to reduce the current in each of the individual contact segments to approximately ⅓ of the full load current thereby reducing the effective blow-apart force developed at the contacts during fault conditions. Each of the three movable contact segments has both an arcing and main contact at right angles to one another and with similar current carrying capacity, and the three segments together effectively provide a total of three pairs or six current paths to the stationary contact when the contactor is closed to reduce the force required to maintain the contacts in the closed position during a fault condition. The mechanical linkage used to provide the necessary contact motion is constructed to provide maximum mechanical advantage for the device. For this purpose, the position of the pivot of the movable contact assembly is such that maximum contact force develops a force in a downward direction past the armature pivot. This effectively minimizes the torque requirement of the magnet structure since the operating lever arm of the armature and movable contact is reduced considerably as compared to that of the lever arm of a conventional structure.

13 Claims, 10 Drawing Figures

ELECTROMAGNETICALLY OPERATED DC POWER CONTACTOR

BACKGROUND OF THE INVENTION

Electromagnetically operated D.C. power contactors have been known heretofore. These prior contactors have used various means in an attempt to improve their high fault current withstandability. One such means has been to increase the size of the magnet in an attempt to maintain enough contact pressure during high fault current conditions. However, this means has the disadvantage that the magnet must be prohibitively large. Another means has been to put a holding coil around the current-carrying member to apply additional force to the contacts when needed during the fault current period. However, this means has the disadvantage that additional apparatus must be incorporated into the contactor resulting in increase in both size and cost. It has also been known to use auxiliary contacts and interlocks between the movable contact and the arc shield. However, these two features have often been incorporated in prior contactors in a rather cumbersome and expensive manner without the direct action and simplicity of the present invention. While such prior contactors have been useful for their intended purpose, this invention relates to improvements thereover.

SUMMARY OF THE INVENTION

An object of the invention is to provide an improved power contactor.

A more specific object of the invention is to provide a power contactor with an improved contact structure.

Another specific object of the invention is to provide a power contactor with an improved trifurcated movable contact structure.

Another specific object of the invention is to provide a power contact with improved arcing and main contact structure affording contact wipe and shearing and rolling action to effect breaking of welds that might occur between the movable and stationary contacts.

Another specific object of the invention is to provide an electromagnetically operated power contactor with an improved linkage structure between the movable contacts and armature to provide the required contact pressure with minimal magnet force.

Another specific object of the invention is to provide an electromagnetically operated DC power contactor with an improved mechanical linkage between the movable contacts and the armature to afford maximum mechanical advantage therefor.

Another specific object of the invention is to provide an electromagnetically operated DC power contactor with an improved mechanical linkage between the movable contacts and the armature whereby the maximum contact force develops a large force component in a direction past the armature pivot to effectively minimize the torque requirement of the magnet since the operating lever arm is reduced substantially.

Another specific object of the invention is to provide an electromagnetically operated DC power contactor of the aforementioned type with an improved interlock between the arc shield and the movable contact to prevent closure of the latter when the arc shield is off.

Another specific object of the invention is to provide an electromagnetically operated DC power contactor of the aforementioned type incorporating auxiliary contacts operated by a pivoted linkage in response to armature movement to provide direct action of the interlock circuits with respect to armature position.

Other objects and advantages of the invention will hereinafter appear.

DESCRIPTION OF THE PREFERRED EMBODIMENT

Figure 1:
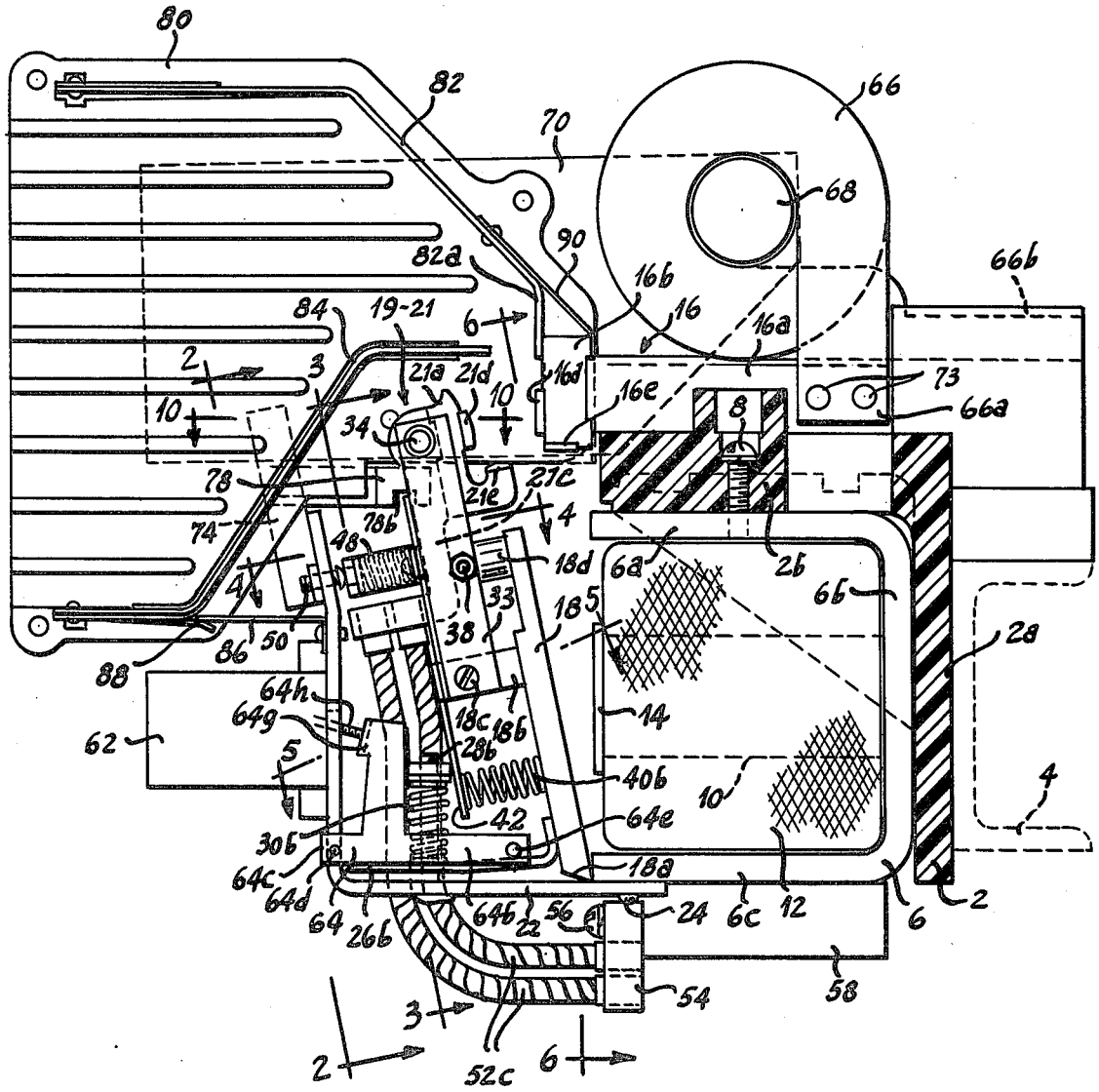
FIG. 1 is a reduced right elevational view, partly in section, of an electromagnetically operated DC power contactor, with the right arc shield and right arc blowout pole piece removed to show the movable contact more clearly as well as the arc horn within the left arc shield.

Referring to FIG. 1, there is shown an electromagnetically operated DC power contactor constructed in accordance with the invention. As shown therein, this contactor is provided with mounting and supporting means comprising a base 2 of molded, electrically insulating material to which the contactor parts are secured and which may be secured as by bolts to a supporting member such as a channel member 4 shown in broken lines. For this purpose, molded base 2 by may be provided with left and right perforated wings (FIG. 6) extending from its rear vertical portion **2*a* through which bolts (not shown) may extend to attach it to channel member 4**.

This contactor is provided with magnetic operating means comprising a generally horizontal U-shaped magnet frame 6. Screws 8 extend through holes in the horizontal portion **2*b* of molded base 2 and are turned into threaded holes in the upper arm 6*a* of U-shaped magnet frame 6 to secure it to the base. As so secured, the yoke 6*b* of the U-shaped magnet frame is flat against the forward wall of vertical portion 2a** of the molded base.

This magnetic operating means also comprises a cylindrical magnetic core 10 connected at one end centrally of yoke 6b of the magnet frame to provide a generally E-shaped magnet frame. This core is surrounded by an operating coil 12 that is held on core 10 by a disc-shaped coil clamp 14 attached to the other end of the core by a central screw or the like.

Figure 6:
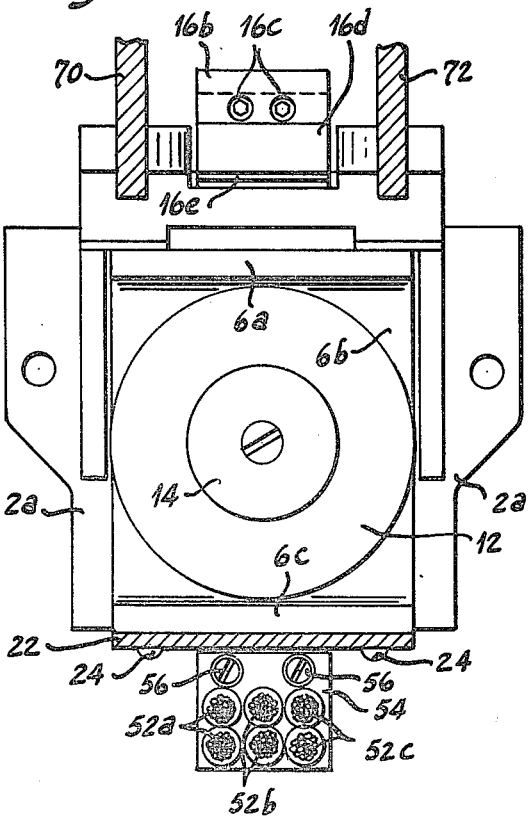
FIG. 6 is a cross-sectional view taken substantially along line 6—6 of FIG. 1 to show the stationary contact and the magnet coil and pole pieces.

Stationary contact 16 is mounted on top of molded base 2. This stationary contact comprises an elongated contact block 16a that is attached by screws extending down therethrough into threaded inserts molded in the base. A contact carrying block 16b is secured by a pair of screws 16c on the forward end of contact block 16 as shown in FIGS. 1 and 6. Contact carrying block 16b has secured thereto an arcing contact 16d on its forward surface and a main (current carrying) contact 16e on its lower surface to provide contact gaps at a right angle to one another as shown in FIGS. 1 and 6. These two contacts are preferably brazed to the contact carrying block for good electrical connection.

The magnet armature 18 which carries the trifurcated movable contact 19, 20, 21 is a flat plate pivotally supported across the magnetic pole pieces or faces at the forward ends of upper arm 6a and lower arm 6c of the magnet frame. For this purpose, a generally L-shaped mounting bracket 22 is rigidly secured at the toe of the L to the lower surface of the tip of lower arm 6c of the magnet frame by screws 24 or the like. This attachment provides a right-angle corner between the lower pole face and the upper surface of mounting bracket 22 to serve as a pivot for the beveled lower end 18a of the armature as shown in FIG. 1.

Figure 3:
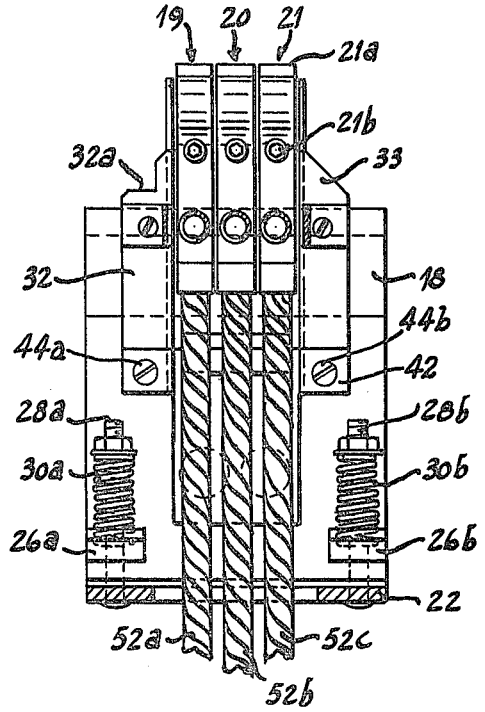
FIG. 3 is a cross-sectional view taken substantially along line 3—3 of FIG. 1 to show the trifurcated movable contact and the flexible conductors connected thereto.

The armature is provided with return spring means for returning the armature to its normal open position shown in FIG. 1 whenever the magnet is deenergized. This means comprises a pair of generally horizontal L-shaped brackets 26a and 26b welded at their foot portions to the front surface of the armature near the left and right edges thereof near its pivoted lower end as shown in FIGS. 1 and 3. As a result, these two brackets extend generally forwardly from the armature so that they swing up when the armature is closed. A pair of bolts 28a and 28b extend up through holes in stationary mounting bracket 22 and through holes in the respective brackets 26a and 26b and then through respective helical compression springs 30a and 30b that are confined on these bolts by suitable washers and nuts threaded on the upper ends thereof. As a result, when the magnet is energized to close the armature, brackets 26a and 26b swing upwardly to compress return springs 30a and 30b. Thus, these compression springs return the armature to open position when the magnet is deenergized.

The trifurcated movable contact mechanism is mounted on the armature so that the three movable contact segments 19, 20 and 21 thereof engage first the arcing contact 16d and then the main or current-carrying contact 16e when the armature is closed. For this purpose, a horizontal mounting bar 18b is rigidly secured as by welding to the front surface of the armature slightly above the middle thereof. This mounting bar 18b has a horizontal hole therethrough and through which a bolt 18c, rivet, or the like extends to pivotally support a lever comprising a pair of spaced apart angle members 32 and 33 most clearly shown in FIGS. 1, 4 and 5. These angle members support the movable contact as hereinafter described.

The movable contact mechanism is trifurcated in that it comprises three like contact segments 19, 20 and 21 as shown in FIG. 3. Each of these contact segments is made of a generally J-shaped contact-carrying member 21a of copper secured by a screw 21b (FIG. 3) back-to-back to a generally L-shaped copper contact lever 21c as shown in FIG. 1. The upper end of contact lever 21c is provided with a lateral hole. A tube passes through these lateral holes in the three contact segments to pivot the latter between the upper ends of angle members 32 and 33 as by a bolt 34 or rivet extending through such tube and corresponding holes in these angle members as shown in FIG. 1.

Figure 4:
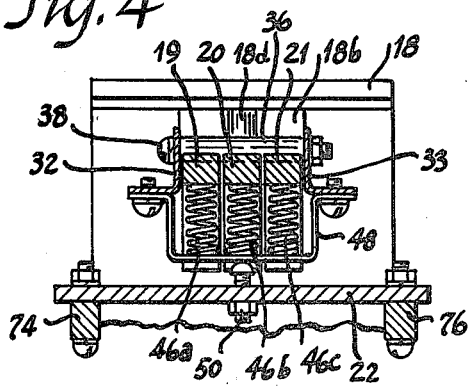
FIG. 4 is a cross-sectional view taken substantially along line 4—4 of FIG. 1 to show the compression springs that provide the contact pressure for the main contacts.

To position the three contact segments with respect to the armature, a stud or post 18d is rigidly secured to the reduced thickness, upper end portion of the armature 18 as shown in FIGS. 1 and 4. A stop is formed by connecting a tube 36 (FIG. 4) between angle members 32 and 33 as by a bolt 38 or rivet passing therethrough and through corresponding holes in these angle members. This tubular stop abuts the end of post 18d as shown in FIG. 1 and the three movable contact segments abut this tubular stop as shown in dotted lines in FIG. 1 to limit the counter-clockwise pivoting of these movable contact segments on their pivot 34.

Figure 5:
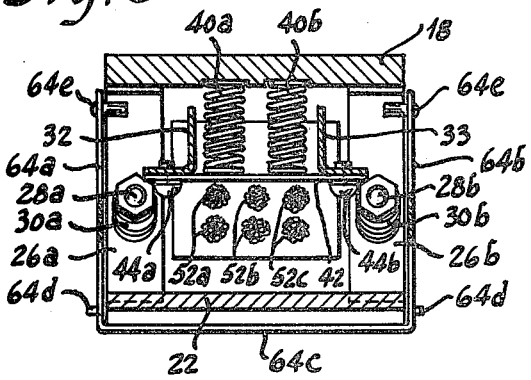
FIG. 5 is a cross-sectional view taken substantially along line 5—5 of FIG. 1 to show the compression springs that provide the initial arcing contact pressure.

The contactor is provided with means for providing resilient initial arcing contact pressure (or force) during armature closing movement. This means comprises a pair of helical compression springs 40a and 40b between the lower end portion of the armature and a generally T-shaped spring support 42. This spring support 42 is rigidly secured by a pair of screws 44a and 44b to the lower ends of angle members 32 and 33 as shown in FIG. 5, these screws passing through holes in the wings of this T-shaped spring support. As will be apparent, this spring support 42 becomes in effect integral with the two angle members and compresses springs 40a and 40b between it and the armature. Alternatively, support 42 could be replaced by extending the lower ends of angle members 32 and 33 and connecting a strip thereacross to support springs 40a and 40b.

Figure 7:
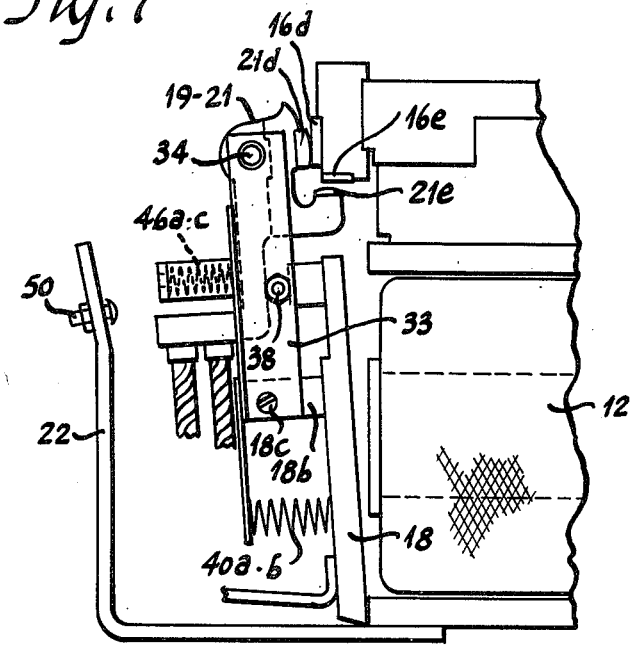
FIG. 7 is a fragmentary view of the contactor of FIG. 1 showing initial closure of the arcing contacts upon initial armature movement.

Each movable contact carrying member such as member 21a is provided with a silver arcing contact element 21d and a silver main (or current-carrying) contact element 21e as shown in FIGS. 1 and 7. Consequently, upon initial closure of the arcing contacts as shown in FIG. 7, the movable contact segments 19–21 along with angle members 32 and 33 will tend to pivot slightly counter-clockwise on bolt 18c to compress springs 40a and 40b resiliently to provide the initial arcing contact pressure.

Figure 8:
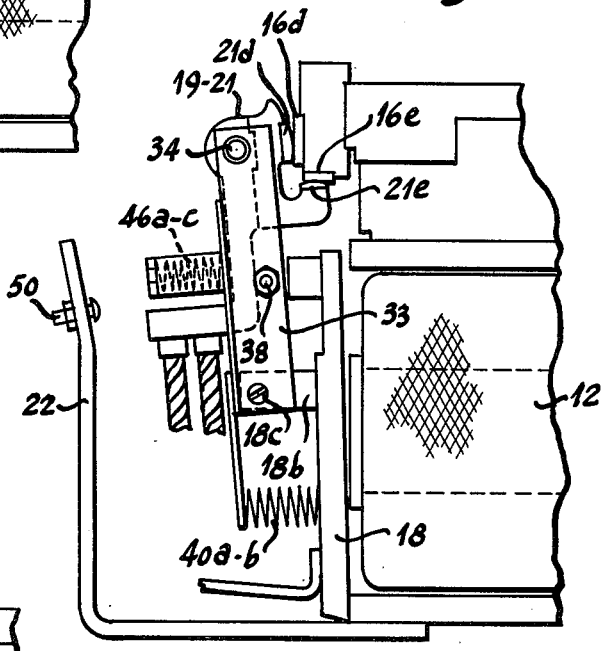
FIG. 8 is a fragmentary view like FIG. 7 but additionally showing initial closure of the main contacts upon further armature movement.

The contactor is provided with means for providing resilient main contact pressure as the armature closes further as shown in FIG. 8. This means comprises three helical compression springs 46a, 46b and 46c shown in FIG. 4. A generally U-shaped bracket 48 is secured at the outwardly-bent tips of its arms across angle members 32 and 33, as shown in FIGS. 1 and 4, by a pair of screws passing through holes in these outwardly-bent tips that are theaded into holes in the angle members. Compression springs 46a–c are compressed between this U-shaped bracket and the respective movable contact segments 19–21 as shown in FIG. 4.

U-shaped bracket 48 is also used as a stop for the opening movement of the armature as shown in FIG. 1. For this purpose, a screw 50 is threaded into the upper portion of mounting bracket 22 and adjusted and locked with a nut. U-shaped bracket 48 stops against the head of this screw to limit the opening movement of the movable contacts.

The contactor is provided with connector and terminal means for the movable contacts. This means comprises three pairs of flexible conductors 52*a*, 52*b* and 52*c* connected at their upper ends to the respective movable contact segments 19–21 as shown in FIGS. 1 and 3 and connected at their lower ends to a terminal plate 54. This terminal plate is connected by a pair of screws 56 to the forward end of a terminal block 58 shown in FIGS. 1 and 6 that is secured by a pair of screws to the lower surface of lower arm 6*c* of the magnet frame. This terminal block is provided with suitable tapped holes for connecting an electrical cable connector lug to serve as one terminal of the contactor, its other terminal being at the blowout coil as hereinafter described.

Figure 2:
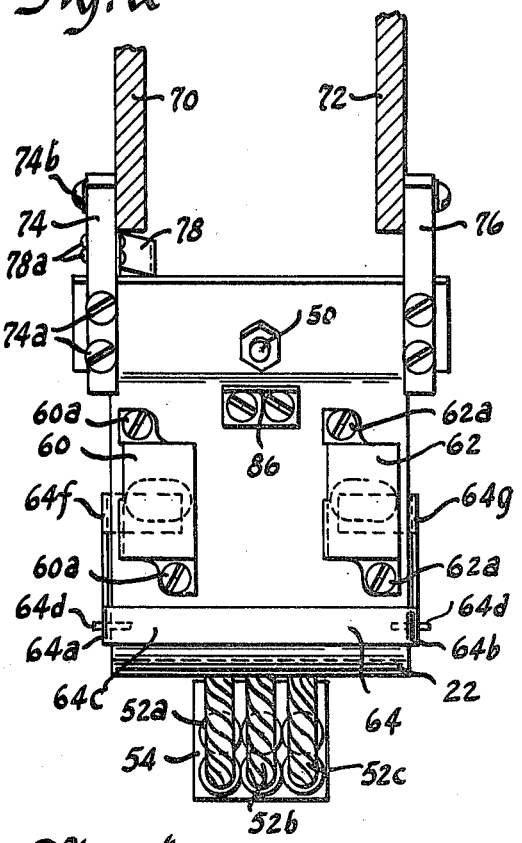
FIG. 2 is a cross-sectional view taken substantially along line 2—2 of FIG. 1 to show the auxiliary contacts and the mounting means for the two blowout magnet pole pieces.

This contactor is provided with auxiliary contacts operable in response to armature position. These auxiliary contacts comprise a pair of interlock contact assemblies 60 and 62 mounted in spaced apart relation on the front surface of mounting bracket 22 and each being secured by a pair of screws 60*a*, 62*a* as shown in FIGS. 1 and 2. Each such interlock contact assembly may enclose within its insulating housing one or more normally-closed or normally-open bridging contacts connected to external terminals whereby these interlock contacts may be connected to an external control circuit.

To operate these auxiliary contacts, the contactor is provided with a generally U-shaped operating lever 64 shown in FIGS. 1 and 2. This operating lever 64 has a left arm 64*a* and a right arm 46*b* connected by a yoke 64*c* and embraces mounting bracket 22 so that these arms extend rearwardly. This lever is pivotally supported on the mounting bracket by a pair of pivot pins 64*d* extending through holes in its arms immediately adjacent the yoke and into holes in the opposite edges of mounting bracket 22. In order to couple operating lever 64 to armature motion, the extremities of arms 64*a* and 64*b* are provided with internal studs 64*e* that overlie brackets 26*a* and 26*b* rigidly secured to the armature. As a result, when the armature closes, brackets 26*a* and 26*b* pivot operating lever 64 counterclockwise. To couple operating lever 64 to interlock contact assemblies 60 and 62, operating lever 64 is provided with a pair of upstanding ears 64*f* and 64*g* having inwardly-bent tabs to which a pair of adjustable screws 64*h* are threaded so that they extend through holes in mounting bracket 22 into the interlock contact assemblies. These screws actuate the auxiliary contacts when operating lever 64 is rotated counter clockwise in response to armature closure. When the armature reopens, the return springs of the auxiliary contacts and the weight of operating lever 64 return the latter to its normal position shown in FIG. 1.

The contactor is also provided with arc blowout means of magnetic type. This means comprises a thick copper blowout coil 66 shown in FIG. 1, a magnetic core 68 extending through the blowout coil and left and right magnetic pole pieces or plates 70 and 72 connected to opposite ends of core 68. The right end 68*a* of blowout coil 66 is connected by a pair of screws 73 to the left surface, at the rear end, of stationary contact block 16*a*. The left end 66*b* of this blowout coil extends rearwardly along the top of molded base 2 and is provided with threaded holes for securing a connector lug serving as the aforementioned other terminal of the contactor, the first terminal being at terminal block 58 below the magnet. Therefore, the circuit through the contactor extends from end 66*b* through the blowout coil, contact block 16*a*, contact carrying block 16*b* and the arcing and main stationary contacts, the trifurcated movable contact, conductor pairs 52*a–c*, and terminal plate 54 to terminal block 58.

Means are provided for supporting the magnetic pole plates 70 and 72 so that they are in optimum position with respect to the arcing contacts and the arc horn hereinafter described. The rear-upper corners of these pole plates may be secured by screws to the opposite ends of magnetic core 68 as generally indicated in FIG. 1. A pair of supports or bars 74 and 76 are used to support the forward ends of the pole plates. As shown in FIGS. 1 and 2, support bar 74 is secured at its lower end by a pair of screws 74*a* to the left-upper corner of mounting bracket 22 and is secured at its upper end by a screw 74*b* to pole plate 70. In a similar manner, support bar 76 is secured by screws to mounting bracket 22 and pole plate 72 at the right side of the contactor. In this way, the magnetic pole plates are rigidly attached to the contactor in spaced part relation so that the arc shield assembly can be inserted therebetween as hereinafter described.

Figure 10:
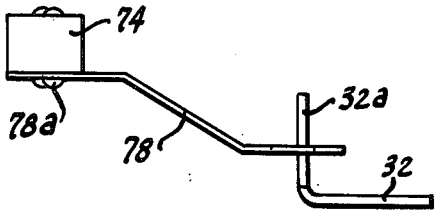
FIG. 10 is a partial cross-sectional view taken substantially along line 10—10 of FIG. 1 to show the interlock between the arc shield and movable contact, that is, the latch that immobilizes the movable contact when the arc shield is removed.

This contactor is also provided with a mechanical interlock that prevents closure of the contacts when the arc shield has been removed. This interlock comprises a latch 78 in the form of a leaf spring hook shown in FIGS. 1, 2 and 10. This leaf spring is secured at its forward end by a pair of screws 78*a* to the inner surface of left pole plate supporting bar 74 as shown in FIG. 2. This leaf spring has two spaced apart bends in it as shown in FIG. 10 to offset its rear end toward the center of the contactor enough so that it will overlie the upper end of left angle member 32*a* as shown in FIG. 10 when it is in its normal relaxed condition. The rear end of this leaf spring latch is provided with a square notch 78*b* extending up from its lower edge to provide a hook for engaging the upper end of the left angle member as shown in FIG. 1. To provide a good catch for this hook, the bevel at the upper end of angle member 32 is provided with a cutout shown in FIG. 3 leaving a horizontal upper edge 32*a* for free entry of hook 78*b* of latch 78 thereon under its own resilient bias when the arc shield assembly is removed. When the arc shield assembly is re-inserted in place, it deflects hook 78*b* of the latch toward the left, clear of edge 32*a* of the angle member, thereby to release the latch to allow the movable contacts to close.

The aforementioned arc shield assembly comprises left-hand arc shield 80 and a complementary right-hand arc shield bolted thereto with an arc horn clamped in grooves therebetween. As shown in FIG. 1, left-hand arc shield 80 has integrally therewith a plurality of lateral arc-separating plates that interleave with similar arc separating plates in the right-hand arc shield when the two are bolted together. The two sets of plates are slightly spaced from each other to provide air spaces for entry of the arcing products when the arc breaks. These arc shields are made of electrically insulating material capable of withstanding repeated blowing of arcs thereinto.

The arc horn is made of electrically conducting metal and comprises an upper strip 82 and a lower strip 84. The rear ends of these arc horn strips are spaced apart a short distance adjacent the arcing contacts and flare out therefrom to their forward ends to stretch the arc in length as it is blown by the blowout magnet therealong.

This arc shield assembly is provided with means for providing an electrical connection between the arc horns and the terminals of the contactor and securely supporting it on the contactor. For this purpose, a bracket 86 is secured by screws to mounting bracket 22 so that it projects forwardly therefrom. Also, a spring 88 is attached to the forward end of arc horn lower strip 84 and is provided with a downwardly-bent end to receive the forward end of bracket 86 between this spring and the lower arc horn strip in tight gripping relation when the arc shield assembly is pushed rearwardly into place. This arc shield assembly supporting means also comprises a leaf spring 90 attached near the rear end of upper arc horn strip 82 so that its bent end and the rear end 82*a* of horn strip 82 are suitably spaced from one another to grip the upper end of stationary contact carrying block 16*b* when the arc shield assembly is pushed in place between the pole plates.

Figure 9:
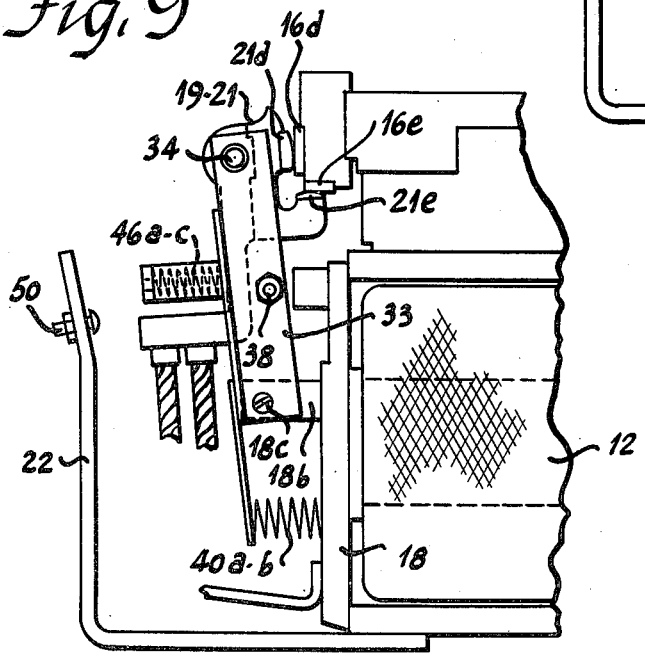
FIG. 9 is a fragmentary view like FIG. 8 but showing full closure of the arcing and main contacts upon complete armature movement.

Referring now to FIGS. 7, 8 and 9 which show operation of the contacts in steps, it is apparent that when the magnet is energized, initial movement of the armature causes the three movable arcing contact elements, such as 21*d* in FIG. 7, to engage stationary arcing contact element 16*d* to close the circuit through the contactor. The initial arcing contact pressure is determined by the compressive force of springs 40*a–b*.

Further closing movement of the armature causes counterclockwise pivoting of the movable contact assembly including angle members 32 and 33 on pivot 18*c*, compressing springs 40*a* and 40*b*. This causes a small amount of upward sliding movement and counterclockwise rocking of the movable arcing contact elements on stationary arcing contact element 16*d*, since the arc of travel of pivot 18*c* has an upward vector component, until the main contact elements close as shown in FIG. 8.

Final closing movement of the armature, as shown in FIG. 9, causes further counter-clockwise pivoting of angle members 32 and 33 with respect to the armature on pivot 18*c*, compressing springs 40*a–b* further. This causes further upward sliding movement and now clockwise rocking movement of the movable arcing and main contact elements on the stationary arcing and main contact elements. This clockwise rocking movement comes about because the arc of travel of pivot 18*c* has an upward vector component pushing the angle members including pivot 34 therewith, and movable main contact element 21*e* is now against stationary main contact element 16*e* and can move no further. Therefore, due to the upward movement of pivot 34, the movable main contacts rock and slide and the movable arcing contacts rock and slide on the corresponding stationary contacts and springs 46*a–c* are compressed when the movable contact segments pivot clockwise on pivot 34.

In the abovedescribed closing operation of the contacts, initial and further arcing contact pressures are provided by springs 40*a–b*. The contact pressure for the main contacts is provided by springs 46*a–c*. And the action of the main contacts after closure results in a portion of the force provided by springs 46*a–c* being transmitted to the arcing contacts thereby increasing the arcing contact pressure beyond that which can be obtained from springs 40*a–b*. This increased pressure is beneficial in carrying the current during normal operation and resisting contact opening during fault conditions.

The mechanical linkage used to provide the necessary contacts motion is constructed to provide maximum mechanical advantage for the device. The position of pivot 18*c* of the movable contact assembly is such that the maximum contact force develops a force in a downward direction through a point near the armature pivot. This effectively minimizes the torque requirement of the magnet structure since the operating lever arm of the armature and movable contact is reduced considerably as compared to that of the lever arm of a conventional structure.

While the apparatus hereinbefore described is effectively adapted to fulfill the objects stated, it is to be understood that the invention is not intended to be confined to the particular preferred embodiment of electromagnetically operated DC power contactor disclosed, inasmuch as it is susceptible of various modifications without departing from the scope of the appended claims.

I claim:

1. A high current switch comprising:

a stationary contact comprising an arcing contact and a main contact having their contact faces at an angle of approximately 270 degrees with respect to one another;

a movable-contact actuator pivotally supported with respect to said stationary contact for movement in a clockwise, contact-closing direction;

a spring-biased movable-contact carrying lever means pivotally supported on said actuator for movement in a counterclockwise direction with respect to said actuator against the force of its bias spring;

a spring-biased movable contact pivotally supported on said lever means for movement in a clockwise direction with respect to said lever means against the force of its bias spring and comprising an arcing contact and a main contact having their contact faces at approximately a right angle with respect to one another;

and means fixing the initial state of said movable contact on said lever means so that upon initial pivotal movement of said actuator in said clockwise, contact-closing direction, said movable arcing contact engages said stationary arcing contact to close the switch;

and additional pivotal movement of said actuator in said clockwise, contact-closing direction causes said lever means to pivot in said counter-clockwise direction with respect to said actuator against the force of its bias spring thereby causing said movable arcing contact to slide and rock on said stationary arcing contact until said movable main contact closes against said stationary main contact;

and further pivotal movement of said actuator in said clockwise, contact-closing direction causes said lever means to pivot further in said counter-clockwise direction with respect to said actuator against the force of its bias spring and also causes said movable contact to pivot in said clockwise direction against the force of its bias spring thereby causing both said movable arcing contact and said movable main contact to rock and slide on the respective stationary arcing and main contacts to afford increased contact force with minimum torque requirement on said actuator to maintain the contacts effectively closed thereby resisting contact opening under fault conditions.

2. The high current switch claimed in claim 1, wherein:

said movable-contact actuator comprises an armature that is pivotally supported to be attracted to the pole faces of an electromagnet when the associated energizing coil is energized.

3. The high current switch claimed in claim 2, wherein:

said movable-contact actuator comprises a return spring for returning said armature to its counterclockwise normal position when the coil of said electromagnet is deenergized.

4. The high current switch claimed in claim 1, wherein:

said movable contact is a trifurcated movable contact.

5. A high current switch comprising:

stationary contact means comprising an arcing contact and a main contact electrically connected and having their contact faces facing non-intersecting directions spaced substantially 90 degrees;

and contact operating means comprising:

a movable-contact actuator member and means pivotally supporting said actuator member with respect to said stationary contact means for pivotal movement in a first, contact-closing direction;

a movable-contact carrying lever means pivoted on said actuator member for movement in the opposite pivotal direction, and lever spring means biasing said lever means in said first pivotal direction with respect to said actuator member;

movable contact means pivoted on said lever means for movement in said first pivotal direction, and movable contact spring means biasing said movable contact means in said opposite pivotal direction, said movable contact means comprising arcing contact means and main contact means having their contact faces facing intersecting directions spaced substantially 90 degrees with respect to one another and complementary to the stationary arcing contact and main contact;

and means initially positioning said movable contact means so that upon initial pivotal movement of said actuator member in said first, contact-closing direction, said movable arcing contact means engages said stationary arcing contact to close the switch, additional pivotal movement of said actuator member in said first direction causes said lever to pivot in said opposite direction against the force of said lever spring means causing said movable arcing contact means to slide and rock on said stationary arcing contact until said movable main contact and said stationary main contact close, and further pivotal movement of said actuator member in said first direction causes said lever to pivot further in said opposite pivotal direction against the force of said lever spring means and causes said movable contact means to pivot in said first pivotal direction against the force of said movable contact spring means thereby causing both said movable arcing contact means and said movable main contact means to rock and slide on their respective stationary contact means at increasing contact forces.

6. The high current switch claimed in claim 5, wherein:

said contact operating means also comprises an operating magnet;

said movable-contact actuator member comprises an armature arranged for pivotal attraction by said magnet;

and said means pivotally supporting said actuator member comprises:

a mounting bracket secured to said magnet and extending therefrom to provide a corner therebetween;

one end of said armature being beveled for pivotal seating in said corner;

and return spring means coupled between said armature and said bracket for retaining said beveled end in said corner and for returning said armature to normal open position whenever said magnet is deenergized.

7. The high current switch claimed in claim 6, said contact operating means also comprises:

an auxiliary contact assembly mounted on said mounting bracket;

and an operating lever pivoted on said mounting bracket and operable in response to attraction of said armature for operating said auxiliary contact assembly.

8. The high current switch claimed in claim 5, wheren said movable contact means comprises trifurcated contacts, each of the three segments having an arcing and a main contact.

9. The high current switch claimed in claim 5, wherein said means initially positioning said movable contact means comprises:

a stop on said movable-contact carrying lever means for limiting the pivotal movement of said movable contact means in said opposite pivotal direction under the force of said movable contact spring means;

and a stop on said actuator for limiting the pivotal movement of said lever means in said first pivotal direction under the force of said lever spring means.

10. An electromagnetically operated high voltage and high current DC power contactor comprising:

an electrically insulating base;

operating means comprising an electromagnet mounted on said base;

a stationary contact mounted on said base and comprising arcing and main contacts electrically connected and arranged substantially perpendicular to one another;

a mounting bracket connected to said electromagnet and extending first forwardly and then upwardly therefrom, said mounting bracket providing a corner next to said electromagnet;

a magnetic armature pivotally supported in said corner for attraction by said electromagnet in a first pivotal direction to closed position;

armature return spring means mounted on said mounting bracket;

a bracket secured to said armature for stressing said armature return spring means upon closure whereby the latter restores said armature to open position when said electromagnet is deenergized;

spring-biased movable contact means and means pivotally mounting said movable contact means on said armature, said movable contact means comprising arcing and main contacts electrically connected and arranged substantially perpendicular to one another and complementary to said stationary arcing and main contacts;

and said perpendicular arrangement of said arcing and main stationary contacts and movable contact means and said pivotal mounting of said spring-biased movable contact means being responsive to operation of said armature to close said arcing contacts first and thereafter to close said main contacts with sliding and rocking of said arcing and main contacts and increase in contact pressure on full operation of said armature.

11. The electromagnetically operated high voltage and high current DC power contactor claimed in claim 10, wherein:

said movable contact means comprises a movable contact having three like segments, each such segment having an arcing contact and a main contact integral therewith and arranged at substantially a 90-degree angle with respect to one another;

and three springs biasing the respective segments.

12. The electromagnetically operated high voltage and high current DC power contactor claimed in claim 11, wherein said means pivotally mounting said movable contact means on said armature comprises:

a spring-biased lever pivotally mounted on said armature, and a lever stop for limiting pivotal movement of said lever in said first pivotal direction but allowing pivotal movement of said lever in the opposite pivotal movement against its spring;

and means pivotally supporting said three movable contact segments on said lever, and a contact stop for limiting pivotal movement of said movable contact segments in said opposite pivotal direction but allowing pivotal movement of said movable contact segments in said first pivotal direction against their bias springs.

13. The electromagnetically operated high voltage and high current DC power contactor claimed in claim 12, wherein:

said contactor comprises an arc blowout magnet having a coil connected to said stationary contact and magnetic pole plates extending on opposite sides of said arcing contacts;

an arc shield mounted between said pole plates;

and a mechanical interlock mounted on said bracket and being operable to latch said armature to prevent operation thereof when said arc shield is removed.

* * * * *